US006883620B1

(12) United States Patent
Cadet

(10) Patent No.: US 6,883,620 B1
(45) Date of Patent: Apr. 26, 2005

(54) DEVICE FOR HYDRAULIC POWER SUPPLY OF A ROTARY APPARATUS FOR PERCUSSIVE DRILLING

(75) Inventor: Bernard Cadet, Lyons (FR)

(73) Assignee: Montabert S.A., Saint Priest (FR)

( * ) Notice: Subject to any disclaimer, the term of this patent is extended or adjusted under 35 U.S.C. 154(b) by 96 days.

(21) Appl. No.: 10/149,971

(22) PCT Filed: Nov. 7, 2000

(86) PCT No.: PCT/FR00/03096

§ 371 (c)(1),
(2), (4) Date: Jul. 12, 2002

(87) PCT Pub. No.: WO01/48350

PCT Pub. Date: Jul. 5, 2001

(30) Foreign Application Priority Data

Dec. 23, 1999 (FR) ..... 99 16411

(51) Int. Cl.[7] ..... E21B 1/00
(52) U.S. Cl. ..... 173/106; 173/8; 173/9
(58) Field of Search ..... 173/4, 8, 9, 10, 173/106, 113, 144, 145, 157, 159; 175/27

(56) References Cited

U.S. PATENT DOCUMENTS 2,860,487 A * 11/1958 Wheeler ..... 173/159
3,230,711 A 1/1966 Swain et al.
3,670,826 A * 6/1972 Hanson et al. ..... 173/4
3,910,358 A * 10/1975 Martinek ..... 173/152
4,006,783 A * 2/1977 Granholm ..... 173/177
4,023,626 A * 5/1977 Salmi et al. ..... 173/8
4,064,950 A * 12/1977 Salmi et al. ..... 173/151
4,074,771 A 2/1978 Morrison
4,257,489 A * 3/1981 Westerberg ..... 173/159
4,271,914 A * 6/1981 Dressel ..... 173/158
4,291,771 A * 9/1981 Perraud ..... 173/106
4,355,691 A * 10/1982 Karru et al. ..... 173/106

(Continued)

FOREIGN PATENT DOCUMENTS

EP 0 168 382 A1 1/1986

(Continued)

*Primary Examiner*—Eugene Kim
*Assistant Examiner*—Paul Durand
(74) *Attorney, Agent, or Firm*—Oliff & Berridge, PLC

(57) ABSTRACT

A device for supplying hydraulic power to a rotary apparatus for percussive drilling (2) whereof the tool (3) is driven in one direction or another and subjected to the action of an impact device (6) acting independently of the rotation, of a hydraulic device (9) with forward movement enabling the tool to generate a pressure force on the ground, and optionally of a suction device (14) for the drilling dusts, driven by a hydraulic motor, the various hydraulic actuating elements being driven from a hydraulic liquid source under pressure through a hydraulic flow divider (16), a set of distributors (17, 18, 19, 20) and an assembly of branch pipes outside the apparatus, such as hose pipes. The device includes a branch pipe external to the apparatus (24) for communicating the return branch pipe (22) of the hydraulic device (4) driving the tool in rotation and the supply line (23) of the impact device (6), to add to the supply rate of the impact device the return flow rate of the rotation driving device.

8 Claims, 4 Drawing Sheets

U.S. PATENT DOCUMENTS 4,369,848 A * 1/1983 Salmi et al. ..... 173/8
4,430,926 A * 2/1984 Wallace ..... 91/516
4,516,467 A * 5/1985 Keeney et al. ..... 91/31
4,711,090 A * 12/1987 Hartiala et al. ..... 60/422
5,064,003 A * 11/1991 Neroznikov et al. ..... 173/106
5,121,802 A * 6/1992 Rajala et al. ..... 173/1
5,564,455 A * 10/1996 Keating et al. ..... 137/2
5,778,990 A * 7/1998 Niemi ..... 175/27
5,913,371 A * 6/1999 Jenne ..... 175/27
6,119,793 A * 9/2000 Siegenthaler ..... 173/11
6,505,689 B1 * 1/2003 Poysti et al. ..... 173/4

FOREIGN PATENT DOCUMENTS

GB 1 593 577 * 7/1981

* cited by examiner

DEVICE FOR HYDRAULIC POWER SUPPLY OF A ROTARY APPARATUS FOR PERCUSSIVE DRILLING

BACKGROUND OF THE INVENTION

1. Field of Invention

The subject of the present invention is a device for supplying hydraulic power to a rotary percussive drilling apparatus.

2. Description of Related Art

The apparatus to which it relates is used for drilling holes intended for extracting rocks and ores, and comprises a drilling tool given a rotational movement and driven in percussion using an impact device which acts independently of the rotation. The apparatus is mounted on an advance device which allows the tool to create a bearing force on the ground during drilling.

FIG. 1 of the attached schematic drawing depicts a device of known type.

This device comprises a perforating hammer 2 equipped with a tool 3 associated with a device for driving in rotation 4 and with an impact device 5. A distributor 6 allows the reciprocating movement of the piston 7 of the impact device 5 to be performed. The perforated hammer is mounted so that it can move with respect to the land which is to be drilled, with the aid of an advance system mounted on slides. The advance system 9 comprises a hydraulic ram, the rod 10 of which bears against a fixed point 12. The advance system is guided by slides 13.

The apparatus also comprises a device 14 for sucking up debris driven by a hydraulic motor 15.

Various movements are obtained from a source of hydraulic liquid under pressure through a flow splitter 16, for example of the gear or static type, which, via four distributors 17, 18, 19 and 20 respectively, supplies the hydraulic motor of the device for driving in rotation, the impact device, the ram of the advance system, and the hydraulic motor of the device for sucking up debris.

Connections are made via a series of hoses.

Known rotary percussive drilling apparatuses are characterized by hydraulic flow rates and pressures which differ according to the movements instigated. The highest pressure is that of the device 14, 15 for sucking up debris and of the advance system 9–13. The pressure of the impact device 5 represents about two-thirds of the highest pressure, while the pressure of the rotary drive device 4 represents about one third of the highest pressure.

The essential advantage of this apparatus is its simplicity, because the supplies of the various movements are independent of one another and require no component other than distributors for carrying out all the functions.

The essential disadvantage lies in the significant pressure differences between the bodies of the flow splitter 16. Given the technology employed in this type of hydraulics component, these significant pressure differences give rise to leaks of hydraulic fluid between the splitter bodies, and this is manifested in a low hydraulic efficiency of the hydraulic supply device of the drilling apparatus.

SUMMARY OF THE INVENTION

The object of the invention is to provide a hydraulic supply device of this type, making it possible to minimize the pressure differences between the various actuators and thereby to improve the hydraulic efficiency of the apparatus, without employing technical solutions which are complex, particularly from a hydraulic viewpoint.

To this end, the device according to the invention, intended for supplying hydraulic power to a percussive rotary drilling apparatus, the tool of which is, on the one hand, driven in rotation in one direction or the other and, on the other hand, subjected to the action of an impact device acting independently of the rotation, of a hydraulic advance device allowing the tool to create a force of bearing on the ground, and possibly of a device for sucking up drilling debris, driven by a hydraulic motor, the various hydraulic actuating members being driven from a source of hydraulic liquid under pressure through a hydraulic flow splitter, a collection of distributors and a collection of pipes external to the apparatus, such as hoses, is characterized in that it comprises a pipe for causing the return pipe of the hydraulic device for driving the rotation of the tool to communicate with the line supplying the impact device, so as to add to the flow supplied to the impact device the return flow from the rotational drive device.

Advantageously, one of the ends of the pipe for placing the return pipe of the hydraulic device for driving the rotation of the tool in communication with the line supplying the impact device is connected to the distributor controlling the supply of the rotational drive device.

It should be noted that the pipe placing the return of the hydraulic device in communication with the supply of the impact device is situated on the outside of the two hydraulic actuators for rotation and impact respectively, which means that a device of known structure can be used, employing a hydraulic motor which is incorporated into the apparatus or independent thereof, while at the same time offering a technical solution that is simple both in the embodiment of the connecting pipe and in the maintenance thereof, because this connection is made on the outside of the main part of the apparatus.

According to a first form of embodiment, the pipe for placing the return pipe of the hydraulic device for driving the rotation of the tool in communication with the line supplying the impact device consists of the line that removes liquid from the rotational drive device, which opens into the line supplying the impact device, upstream of the distributor controlling the supply of the latter.

In this case, the issue is simply one of connecting the line discharging hydraulic liquid from the rotational drive device to the line supplying the impact device, instead of correcting it directly to the hydraulic reservoir.

According to another form of embodiment of this device, the pipe placing the return pipe of the hydraulic device for driving the rotation of the tool in communication with the line supplying the impact device opens into this line supplying the impact device downstream of the distributor controlling the supply of the latter.

According to another form of embodiment of this device, the pipe placing the return pipe of the hydraulic device for the rotational drive of the tool in communication with the line supplying the impact device opens, on the one hand, into this line supplying the impact device and, on the other hand, into a valve placing the return pipe of the rotational drive device in communication with the line supplying the impact device, this valve being controlled and causing the two circuits to be placed in communication when the impact device is operated.

As a preference, in this case, the valve for placing the two circuits in communication is operated by a pressure tapping on the line supplying the impact device. When the impact device is not operated, the return line of the hydraulic motor for rotational drive is connected to the reservoir, whereas when the impact device is in operation, the valve is operated to convey the hydraulic liquid leaving the rotational drive device toward the supply line of the impact device.

BRIEF DESCRIPTION OF THE DRAWINGS

In any event, the invention will be clearly understood with the aid of the description which follows, with reference to the appended schematic drawing which, by way of nonlimiting examples, depicts several forms of embodiment of this device.

DETAILED DESCRIPTION OF EXEMPLARY EMBODIMENTS

Figure 1:
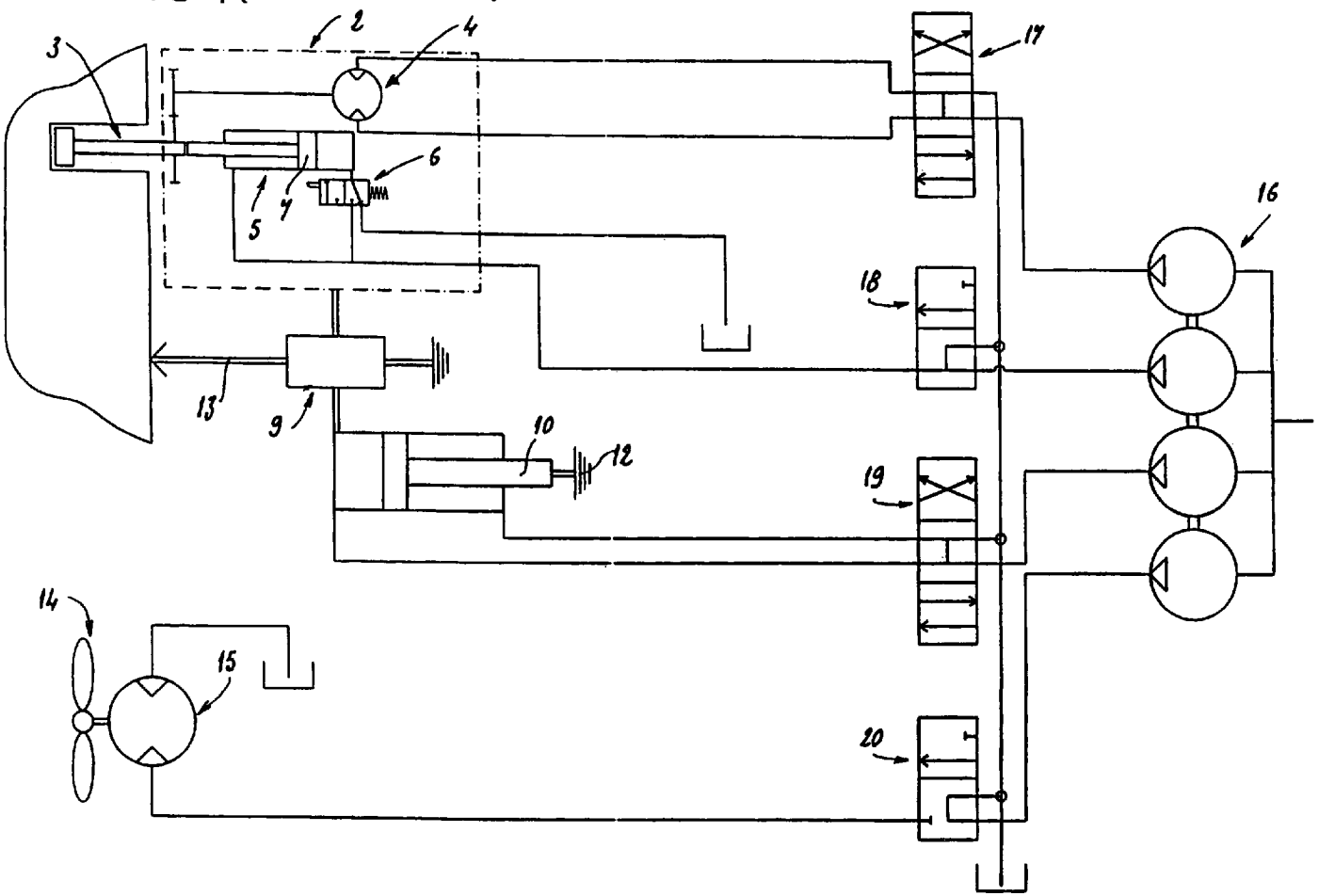
FIG 1 (RELATED ART)
FIG. 1 is a schematic of a conventional device for supplying hydraulic power.
Figure 2:
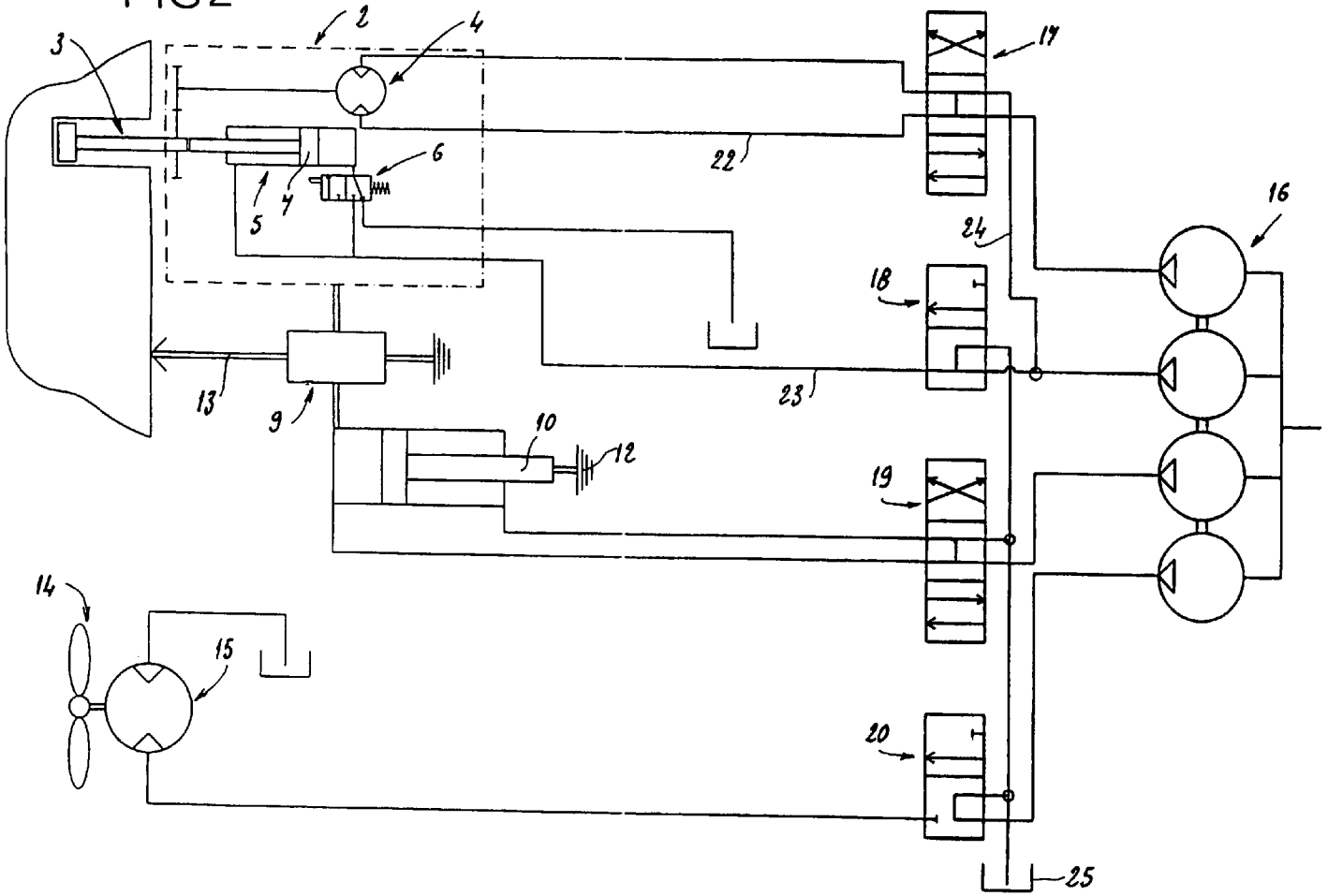
FIG. 2 is an exemplary embodiment of a hydraulic supply device according to this invention.
Figure 3:
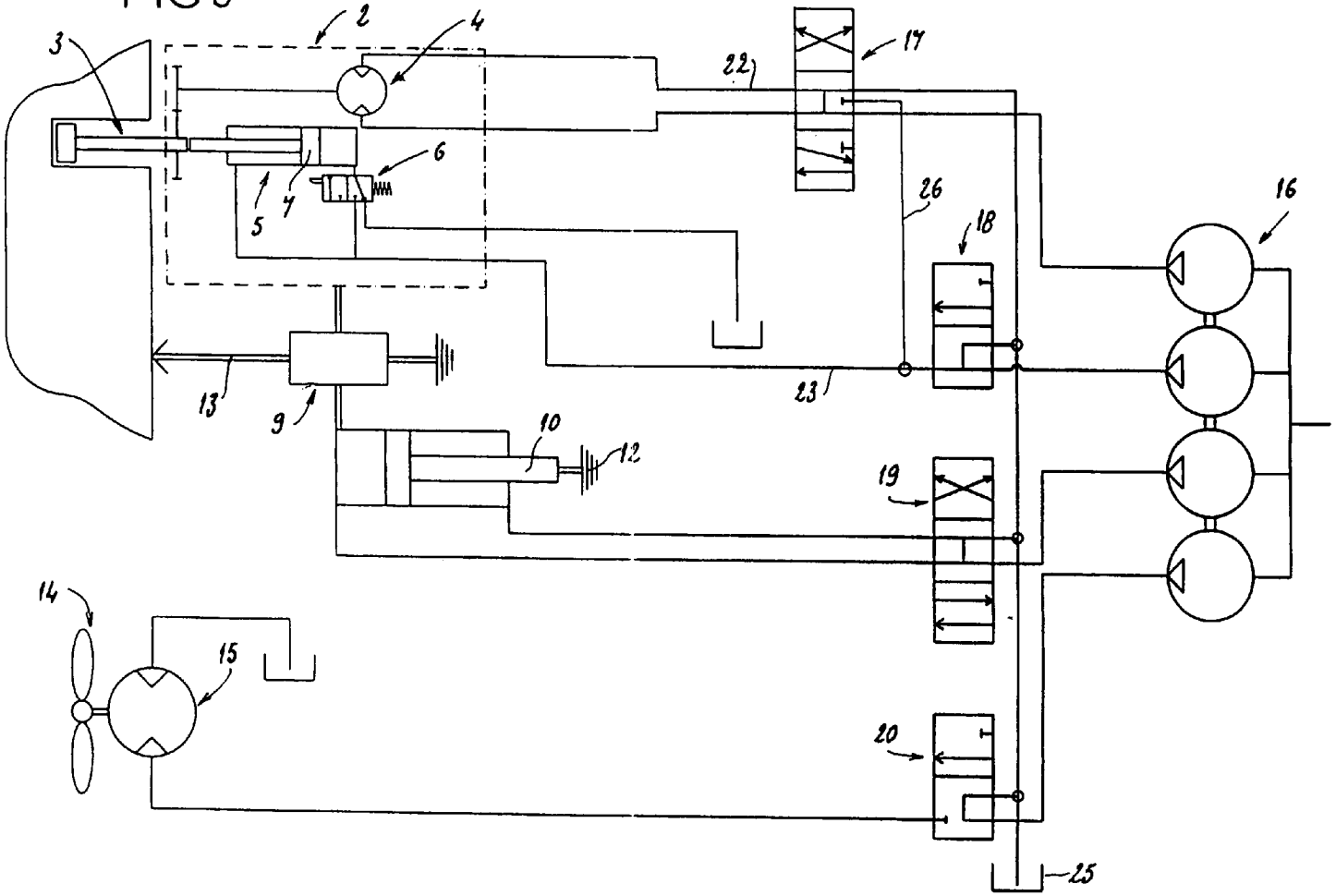
FIG. 3 is a second exemplary embodiment of a hydraulic supply device according to this invention.
Figure 4:
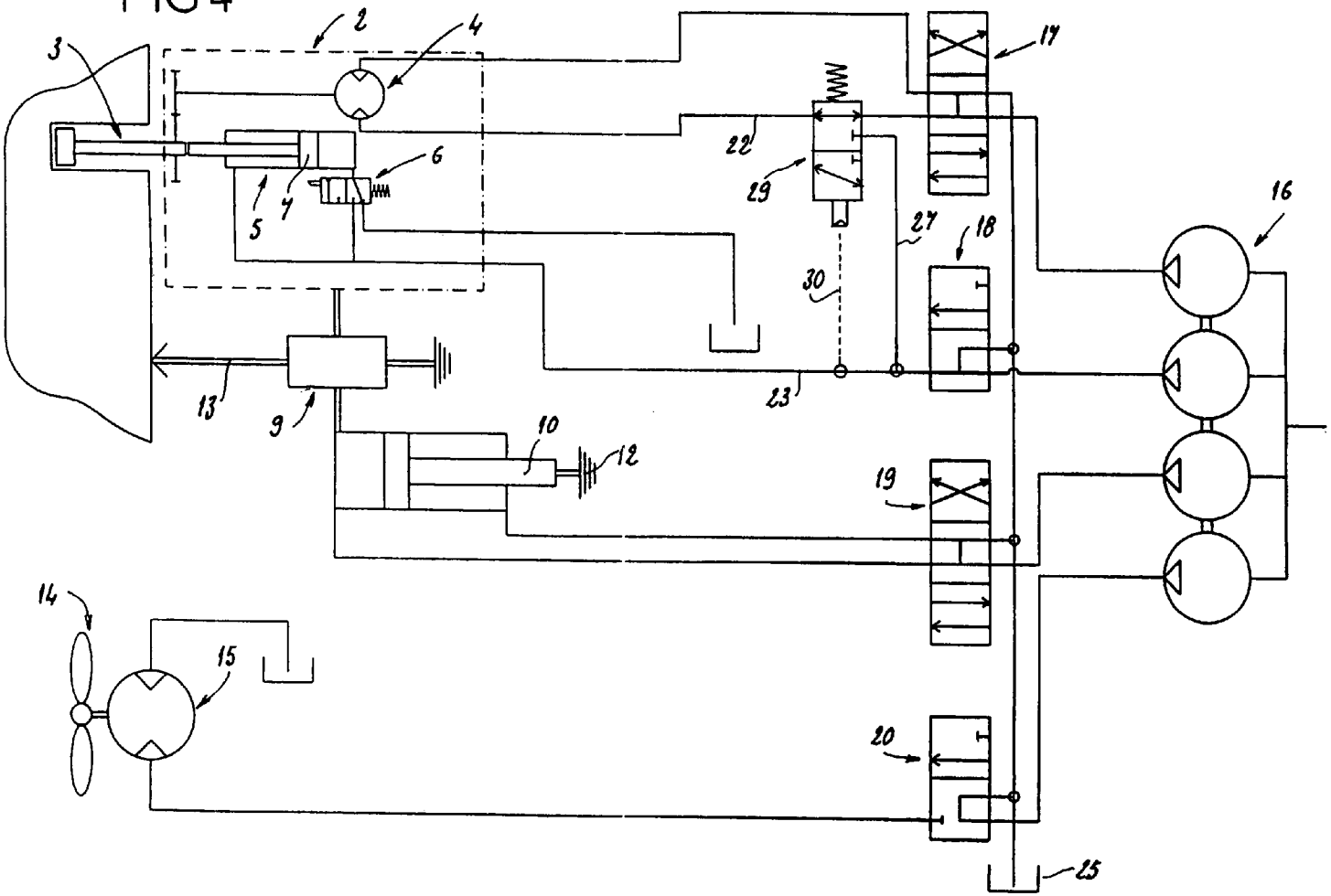
FIG. 4 is a third exemplary embodiment of a hydraulic supply device according to this invention.

In the various forms of embodiment of FIGS. 2 to 4, the same elements are denoted by the same references as in FIG. 1.

In the form of the embodiment depicted in FIG. 3, the return pipe 22 of the device for driving the rotation 4 of the tool is placed in communication with the line 23 supplying the impact device, via the line 24 for removing liquid from the rotational drive device, having passed through the distributor 17. For this purpose, the line 24 opens into the supply line 23 of the impact device, in the region thereof that lies between the flow splitter 16 and the distributor 18. When the rotational drive device is supplied with hydraulic liquid, and the impact device is not in operation, the liquid is removed through the distributor 18 to the reservoir 25. This is the position depicted in FIG. 2. Conversely, when the distributor 18 is in its position for supplying the impact device, the return flow from the rotational device is added to the flow supplying the impact device.

In the form of embodiment depicted in FIG. 3, the device comprises a pipe 26 for placing the return pipe of the hydraulic device for driving the rotation of the tool in communication with the pipe 23 of the line supplying the impact device. This pipe 26 opens into the line 23 downstream of the distributor 18 that controls the supply of the impact device.

In the form of embodiment depicted in FIG. 3, the rotational drive device 4 is supplied so that it can rotate in both directions. For this, the distributor 17 is arranged so that it can supply the two supply and return lines of the device 4 in a crossover fashion so that the supply line can be used as a return line and vice versa. The pipe 26 is connected to the distributor 17 and is placed in communication with the return line 22, this return line being the top and bottom line in the drawing, that is to say the one that does not supply the device 4.

In the form of embodiment depicted in FIG. 4, the device comprises a pipe 27 for placing in communication the return line 22 of the rotational drive device 4, this pipe 27 opening, on the one hand, into the line 23 supplying the impact device, downstream of the distributor 18 and, on the other hand, into a valve 29 able either to place the line 22 in communication with a line that opens into the slide valve 17 or to place the return line 22 in communication with the pipe 27. For that, this valve is controlled off a pressure tapping line 30 communicating with the line 23 supplying the impact device, so that the valve causes the line 22 to communicate with the line 23 via the pipe 27 only when the impact device is operated.

As is evident from the foregoing, the invention provides a great improvement to the known art by providing a device of simple design that makes it possible to minimize the pressure differences between the various actuators by using the output flow from the device for driving the rotation of the tool to add to the flow supplied to the impact device without employing a technical solution which is complex, particularly from the hydraulic standpoint, because this connection is made entirely on the outside of the apparatus, without requiring modifications to the design thereof.

As goes without saying, the invention is not restricted merely to the forms of embodiment of this device which have been described hereinabove by way of examples; on the contrary, it is encompasses all alternative forms thereof.

What is claimed is:

1. A device for supplying hydraulic power to a percussive rotary drilling apparatus including a tool, a rotational drive device for rotating the tool, and an impact device for reciprocating the tool independently of the rotation, the device supplying hydraulic power via a hydraulic liquid under pressure, the device comprising:

a flow splitter that pressurizes and separates a flow of the hydraulic liquid into at least a first portion and a second portion;

a plurality of distributors that control the supply of the pressurized hydraulic liquid from the flow splitter;

a plurality of pipes that supply the pressurized hydraulic liquid between the distributors, and the drive device and the impact device, the plurality of pipes including:

an impact device supply pipe that supplies the first portion of the pressurized hydraulic liquid to the impact device;

a return pipe that returns the second portion of the pressurized hydraulic liquid from the rotational drive device to the impact device supply pipe;

an external pipe connecting the return pipe and the impact device supply pipe so that the second portion of the pressurized hydraulic liquid flowing through the return pipe may be added to the first portion of the pressurized hydraulic liquid flowing through the impact device supply pipe, wherein the external pipe is located externally of the percussive rotary drilling apparatus.

2. The device according to claim 1, wherein the external pipe is connected to one of the distributors that controls the supply of the pressurized hydraulic liquid to the rotational drive device.

3. The device according to claim 2, wherein the external pipe removes liquid from the rotational drive device, and opens into the impact device supply pipe upstream of one of the distributors that controls the supply of the pressurized hydraulic liquid to the impact device.

4. The device according to claim 2, wherein the external pipe opens into the impact device supply pipe downstream of one of the distributors that controls the supply of the pressurized hydraulic liquid to the impact device.

5. The device according to claim 1, wherein the external pipe removes liquid from the rotational drive device, and opens into the impact device supply pipe upstream of one of the distributors that controls the supply of the pressurized hydraulic liquid to the impact device.

6. The device according to claim 1, wherein the external pipe opens into the impact device supply pipe downstream of one of the distributors that controls the supply of the pressurized hydraulic liquid to the impact device.

7. The device according to claim 1, wherein the external pipe opens into the impact device supply pipe, and is connected to a valve that places the return pipe in communication with the impact device supply pipe, the valve being controlled to cause the second portion of pressurized hydraulic liquid to be added to the first portion of the pressurized hydraulic liquid when the impact device is operated.

8. The device according to claim 7, wherein the valve is operated by a pressure tapping from the impact device supply pipe.

* * * * *